United States Patent [19]

Buffet

[11] 4,243,172

[45] Jan. 6, 1981

[54] CENTRIFUGES HAVING A BOWL OPENABLE WHILE IN OPERATION

[75] Inventor: Denis Buffet, Meyzieu, France

[73] Assignee: Robatel, S.L.P.I., Genas, France

[21] Appl. No.: 937,001

[22] Filed: Aug. 25, 1978

[30] Foreign Application Priority Data

Sep. 6, 1977 [FR] France ..... 77 27536

[51] Int. Cl.[2] ..... B04B 1/14

[52] U.S. Cl. ..... 233/20 A; 233/1 A

[58] Field of Search ..... 233/1 R, 1 A, 20 R, 233/20 A

[56] References Cited

U.S. PATENT DOCUMENTS

| | | | |
|---|---|---|---|
| 2,927,829 | 3/1960 | Porter | 277/135 |
| 3,765,599 | 10/1973 | Hemfort | 233/20 A |
| 4,054,244 | 10/1977 | Paschedag | 233/20 A |

*Primary Examiner*—George H. Krizmanich
*Attorney, Agent, or Firm*—Dowell & Dowell

[57] ABSTRACT

A centrifugal separator including a bowl rotatable about an axis having a bottom and a cover separated by an intermediate flange portion having an annular row of discharge openings, a hollow piston-like member in the bowl axially moveable between a position in which it is sealed against the cover and a position in which it is retracted from the cover and communicates with said discharge openings, a liquid control system for moving the piston-like member between said axial positions while the bowl is rotating, and an hydraulic seal system including an annular gutter-shaped member around the inside of said intermediate flange portion and containing a dense sealing liquid such as mercury and an annular sealing member extending from the periphery of the piston-like member into the gutter-shaped member and sealed therewith by the sealing liquid, the sealing liquid and the control liquid interfacing near the gutter-shaped member and effecting a balance therebetween due to gravitational and centrifugal forces acting thereon.

10 Claims, 4 Drawing Figures

Figure 2:
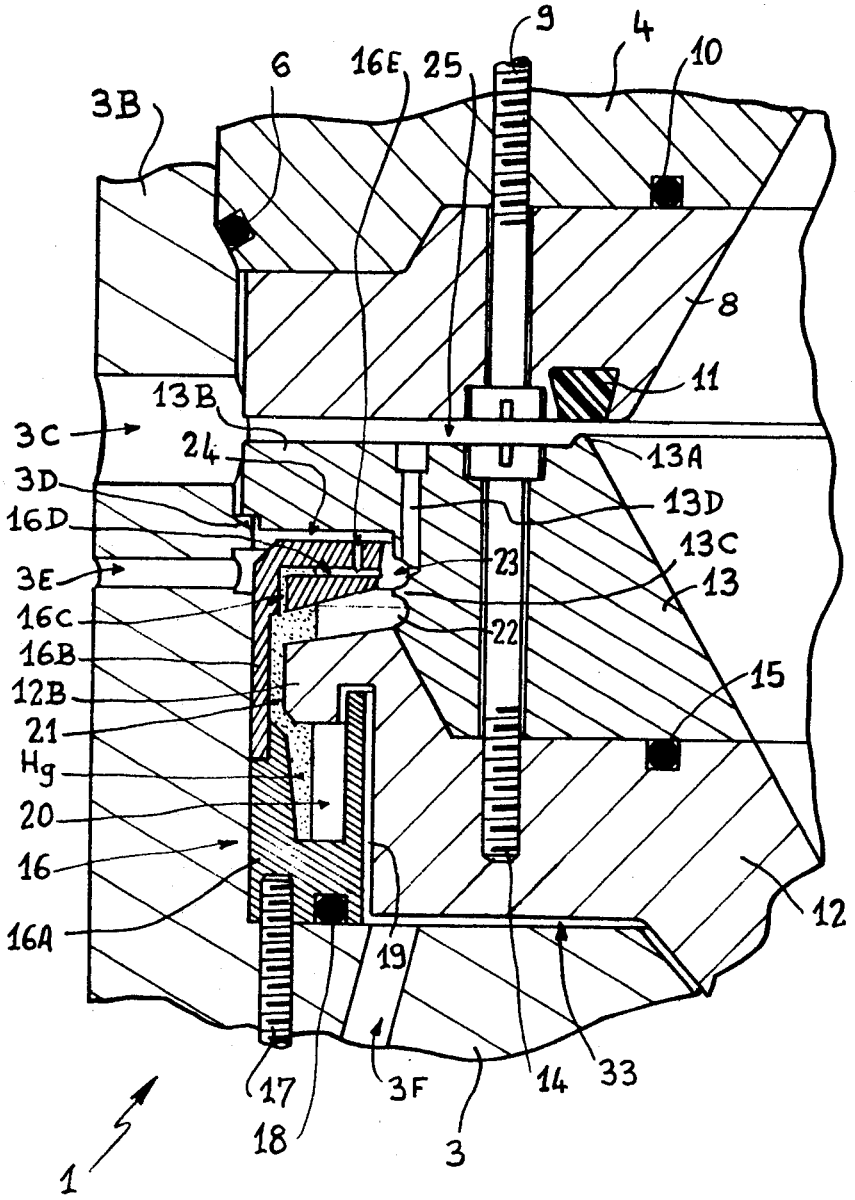

Fig. 1
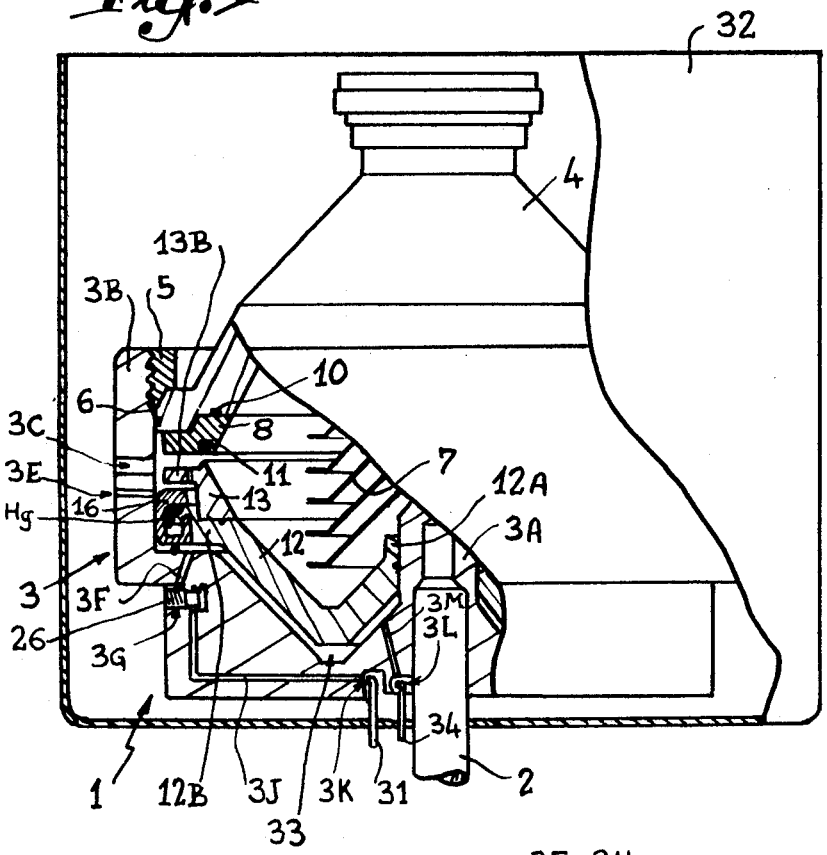
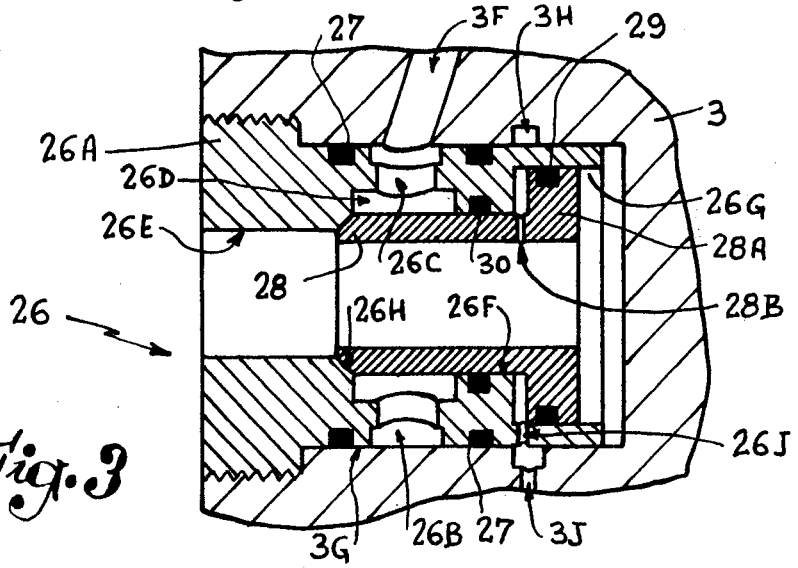
Fig. 3

CENTRIFUGES HAVING A BOWL OPENABLE WHILE IN OPERATION

It is known that, in certain high speed centrifuges often called "centrifugal separators" the bowl, generally provided to be biconical, is arranged so that it is possible to open is around its largest diameter during operation, so as to determine a passage through which are expelled the products or sludge decanted against its inner wall. The machines of the type in question generally comprise an annular portion constituting one of the walls of the bowl, this portion being normally urged axially against a suitable seal, but being able to be separated therefrom, for example under the influence of an hydraulic control, so as to control the passage of expulsion or ejection mentioned above. The rotating bowl being surrounded by a fixed casing, the latter may thus periodically receive the sludge separated by centrifugal force without it being necessary to stop the machine.

The machines of the type in question are theoretically perfect, but in practice they have numerous drawbacks. Firstly, great care must be taken in guiding the mobile wall portion axially and, in the case of hydraulic control universally used at the present time, where this wall portion forms a piston like member a seal must be provided between it and the inner periphery of the bowl. For the guiding to be perfect and the seal not to be extruded by pressure through the clearance made between the pieces, said clearance must be provided to be very small and the surface states must be excellent. This therefore involves extremely expensive machinings.

Furthermore, the high pressures brought into play produce elastic deformations of the pieces and said pieces must therefore be provided to be very resistant and very rigid. Despite these precautions the above-mentioned deformations limit the precision of assembly and accordingly require larger clearances to be made than would be desirable.

Moreover differences in temperature and the differences in expansion which they cause initiate similar difficulties.

Finally, the treated suspensions may in the long run have a corrosive effect on the surfaces in question, this causing abrasions, wear of the seals, etc., with the result that the apparatus requires a fair amount of maintenance.

It is an object of the present invention to remedy the above-mentioned drawbacks. In accordance with the invention, the tightness between the axially mobile wall or piston-like member and the axially fixed wall of the bowl is ensured by a hydraulic seal using a liquid with a very high density, such as for example, mercury.

It is understood that, in these conditions, a large clearance can be made between the mobile wall or piston-like member and the inner periphery of the bowl. The guiding of the mobile wall is then ensured solely by its central part, which is located in a zone of zero or very low pressure, which does not require a delicate seal.

The hydraulic seal may advantageously comprise a nose integral with the mobile wall or piston-like member and which penetrates radially and outwardly between a lower trough of a gutter-shaped member which is integral with the wall of this bowl and which is not axially mobile, and an upper annular portion oriented radially inwardly, so that the heavy liquid collects in the lower trough when the centrifuge is at rest, but rises and surrounds the nose under the effect of the centrifugal force when it rotates, the difference in radial level between the upper and lower columns of this liquid located on either side of the nose balancing the pressure of the control liquid.

The invention will be more readily understood on reading the following description with reference to the accompanying drawings, in which:

FIG. 1 is a general view with parts broken away, of a centrifuge or centrifugal separator applying the present invention.

FIG. 2 reproduces on a larger scale a portion of FIG. 1 which corresponds to the hydraulic seal and to the components which are directly associated therewith, the whole being assumed to be in the position of opening of the sludge ejection passage.

FIG. 3 similarly reproduces in detail the valve of the hydraulic control in the bottom of the bowl of the machine.

Figure 4:
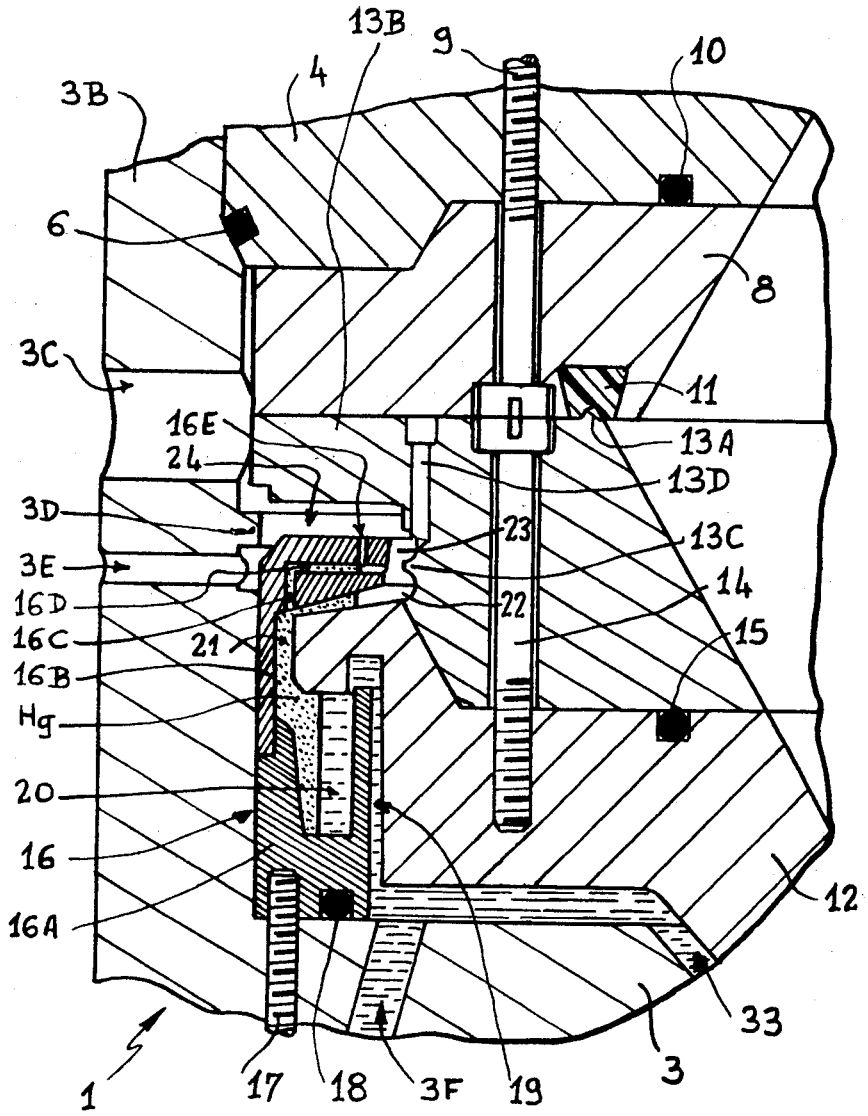

FIG. 4 is a view similar to FIG. 2, but showing the components in the position of closure of the ejection passage.

Referring now to the drawings, the high speed centrifuge shown as a whole in FIG. 1, conventionally comprises a biconical bowl 1 mounted on a shaft 2. In the example shown, this bowl comprises a lower pan or bottom 3 integral on the one hand with a cylindrical hub 3A and on the other hand with a likewise cylindrical vertical intermediate flange 3B, inside of which is engaged the periphery of a cover 4 held in position against a truncated bearing surface by an annular nut 5. 6 denotes the seal between the pan and the cover. The top of the cover conventionally includes an orifice for the inlet of the suspension to be treated and for the outlet of the clarified liquid. 7 denotes in FIG. 1 the superposed truncated discs or plates conventionally provided inside the bowl 1.

Against the lower face of the edge of the cover 4 is added an interchangeable annular piece 8 (FIG. 2) fixed in place by screws such as 9 with the interposition of a seal 10. This piece bears on its lower face a thick annular seal 11 of trapezoidal section located at a radius from the axis of the shaft which is notably less than the radius of the inner surface of the flange 3B of the pan 3.

Inside the bowl 1 thus established is disposed a mobile secondary bottom or piston-like member 12 having a section similar to that of the bottom of the bowl 3, this bottom being integral with a hub 12A (FIG. 1) mounted to slide on the hub 3A of said bowl. The bottom 12 is fitted with an added peripheral edge 13 (FIG. 2) fixed in place by screws such as 14 with the interposition of a seal 15. On the upper face of the edge 13 there is provided an annular projection 13A adapted to cooperate with the above-mentioned seal 11.

Between the periphery of the mobile piston like member 12 and the vertical flange 3B of the lower pan 3 of the bowl, there is interposed an annular gutter-shaped piece 16. This piece comprises a lower portion 16A in the form of an annular upwardly-opening trough which screws such as 17 fix in place in the inner angle of connection between the flange 3B and the truncated body of the lower bowl 3, a seal 18 ensuring the tightness. The periphery of the mobile piston-like member 12 extends below the added edge 13 by a sort of nose 12B curved downwardly and engaging inside the above-mentioned trough 16A of the piece 16. This latter extends upwardly along a lateral wall 16B, made fast with the former in any suitable manner, for example by welding (or as a variant by screwing with the interposition of a seal), this lateral wall portion taking the general form of a rectangle whose vertical wall of small thickness is applied against the flange 3B, whilst its thicker, horizontal wall is oriented in the direction of the axis of the centrifuge between the nose 12B and an extension 13B of the added edge 13. The annular gutter 16 defines not only an upwardly opening lower trough 20 but also a radially inwardly opening gutter into which nose 12B also extends.

Between the cylindrical periphery of the edge of the mobile piston-like member 12 and the inner face of the annular trough 16A of the piece 16, there is provided a vertical annular space 19 of small width whose role will be explained hereinbelow. For convenience of the description of the functioning, 20 denotes the interior of said trough 16A, 21 the space made between the nose 12B and the vertical wall of the rectangle 16B, 22 the space which separates said nose 12B from the horizontal wall of said rectangle 16B, 23 the space between the above-mentioned horizontal wall and the wall of the added edge 13 which faces it in the radial direction, and finally 24 the space made between said wall and the extension 13B of said edge. It will be noted that the spaces 22 and 23 are separated by a projection 13C which is integral with the added edge 13 and which determines a constriction or deflector at the level of the lower face of the horizontal arm of rectangle 16B which deflects sealing liquid from the space 22 downwardly away from the space 23.

25 denotes the space between the upper face of the added edge 13 and the lower face of the piece 8. Opposite this space, the vertical flange 3B is perforated with a circular row of openings 3C. Below these openings, the wall of the flange 3B comprises an inner projection 3D adapted to form a stop for the extension 13B by thus limiting the descending stroke of the mobile piston-like member 12. A little lower, this wall is perforated with another row of openings 3E which communicate with the space 24 through suitable annular clearances. Furthermore, in the thickness of the horizontal arm of the part 16B of the gutter-shaped piece 16, there is provided, at at least two diametrically opposite points, a bent channel comprising an ascending duct 16C leaving the space 22, then a horizontal duct 16D (which may, or may not, open in the space 23, as shown), and then a vertical duct 16E which opens into the space 24. Finally, in the zone of connection between the added edge 13 and its extension 13B, at least one vertical channel 13D has been provided, which communicates the spaces 23 and 25. This channel may normally be closed by a suitable stopper, (not shown), such as, for example, a screw.

From the bottom of the bowl 3 and in the immediate vicinity of the gutter-shaped member 16 there extend two diametrically opposite channels 3F, each of which terminates in a small chamber 3G (FIG. 3) in the form of a horizontal blind bore. Of course, and contrary to what is shown in FIG. 2, the channels 3F and the screws 17 are never in the same diametrical plane so as not to interfere. In this chamber 3G is engaged a tubular stopper 26 whose head 26A is screwed in the threaded inlet of larger diameter of the chamber. The stoper 26 has a peripheral groove 26B hollowed therein, which communicates with the opening of the corresponding channel 3F, this groove being bordered by two seals 27. Radial openings 26C communicate said groove 26B with another groove 26D hollowed in the wall of the bore of the stopper 26. This bore comprises three parts, namely an outer part 26E of small diameter, an intermediate part 26F of average diameter in which the groove 26D is made, and an inner part 26G of large diameter. In this latter part slides a piston constituted by the annular head 28A of a tubular valve 28, and a peripheral seal 29 ensuring tightness. The body of this valve 28 slides in the intermediate part 26F of the bore of the stopper 26, a seal 30 being provided in a groove of the stopper. The truncated free end of the valve 28 bears against a seat 26H provided at the join of the two parts 26E and 26F of the above-mentioned bore.

A narrow calibrated channel 28B passes through the wall of the body of the valve 28 in the immediate vicinity of its head 28A.

The wall of the chamber 3G is provided with a circular groove 3H located in a diametrical plane which, when the stopper 26 is completely screwed, into place is located plumb with the shoulder separating the intermediate and inner parts 26F, 26G of the bore of the stopper 26. Openings 26J provided in the wall of the stopper communicate this groove with the inner part 26G mentioned above.

From the groove 3H there extends a channel 3J (FIG. 1) which terminates in a groove 3K made in the lower face of the bowl 3. This groove may receive liquid from a curved nozzle 31 fixed to the casing 32 of the centrifuge. Concentrically to this groove 3K, there is another groove 3L provided from which at least two diametrically opposite channels 3M communicate with the space 33 included between the upper face of the bowl 3 and the lower face of the mobile piston-like member 12 (FIG. 1 and 2). There again, a fixed nozzle 34 is disposed, which enables liquid to be injected into said groove.

Operation is as follows:

Before the centrifuge is first used, a little mercury is injected through one of the channels 13D into the space 22. This very heavy liquid flows into the space 21 and thus arrives at the trough 20 made inside the lower part 16A of the piece 16. By dismantling the cover 4, one has access to the channels 13D. It is, moreover, possible to extend these channels radially by grooves or channels in order to allow the trough 20 to be filled without removing the cover.

When the centrifuge is switched on, the mercury (referenced Hg in FIGS. 2 and 3) is applied by centrifugal force against the outer wall of the trough 20 and against the ascending wall of the portion of gutter 16B. It, therefore, constitutes a hydraulic seal on either side of the nose 12B, as shown in FIG. 2.

However, to be able to use the centrifuge thus rotated, it is, of course, firstly necessary to raise the mobile piston-like member 12 in order to seal the projection 13A against the seal 11 and thus to close the periphery of the bowl. To this end, a suitable liquid such as water, oil, etc., depending on the conditions of compatibility with what the casing 1 must contain, is injected through the control nozzle 34 of FIG. 1. This liquid fills the groove 3L and, through the channel 3M, it reaches the space 33 under the effect of the centrifugal force (the air being evacuated between the hubs 3A and 12A). It cannot escape through the channel 3F, since the valve 28 is applied on its seat by the centrifugal force. It, therefore, rises through the narrow space 19 which chokes it and restricts its flow, and it thus reaches the trough 20 from which it tends to displace the mercury. However, this determines a difference in radial level between the fraction or column of the mercury located in a first peripheral column adjacent to the trough 20 and that located in a second column adjacent to the space 22. Due to the high density of the mercury, this difference very quickly balances the action of the control liquid Hg flow through a third peripheral column 21. However, at the same time, this control liquid has exerted on the mobile piston-like member 12 the ascending thrust necessary for closing the bowl. The position of FIG. 4 is thus reached.

It is important to note that:

the surface of useful section on which the control liquid acts is clearly greater than that on which the liquid suspension contained in the bowl acts, since the outer radius of the nose 12B is much greater than the radius of the projection 13A, so that the ascending thrust exerted by the control liquid in the space 33 is always greater than the descending thrust resulting from the action of the suspension on the mobile piston-like member 12;

due to the narrowness of the vertical space 19, the sharp variations in pressure resulting from the inlet of the control liquid, or from its evacuation through the valve 28 cannot provoke oscillatory phenomena capable of driving the mass of mercury Hg from the trough 20 completely;

finally, the rounded projection 13C forms a deflector to return, downwardly, any drops of mercury possibly projected from the mass Hg for instance by vibratory forces.

It should further be noted that, during filling, care is taken, as a safety measure, to introduce an excess of mercury in the trough 20. When the centrifuge has reached its running speed, this excess is evacuated by itself through channel 16C–16D–16E and it is formed again in the bottom of the casing 32 of the machine.

When it is desired to evacuate the sludge or heavy products deposited against the inner periphery of the bowl, or more exactly between the piece 8 of the cover 4 and the added edge 13 of the mobile piston-like member 12, liquid is injected into the groove 3K through the nozzle 31. This liquid flows into the channel 3J and thus arrives in the groove 3H and the opening 26J. The calibrated channel 28B being of very small section, the liquid acts on the head 28A to push it to the right in FIG. 3 against the centrifugal force thereby opening the valve 28 and the channel 3F. The control liquid which filled the space 33 may thus escape, the pressure disappears beneath the mobile piston-like member 12 and said latter, therefore, moves down to separate the projection 13A from the seal 11 and open, a passage through which the sludge may evacuate. During this evacuation, the mass of mercury Hg returns to the position of FIG. 2. There again, the narrow space 19 dampens any oscillatory phenomenon.

As soon as evacuation is terminated, the nozzle 31 is stopped. The control liquid which acted on the head 28A escapes through the calibrated channel 28B and the valve 28 returns to the closed position under the effect of the centrifugal force. The mobile bottom 12 then rises again and the pieces take the normal operating position of FIG. 4.

In certain applications, it may be advantageous to protect the surface of the mercury by means of a suitable liquid not miscible with the control liquid and more dense than it but less dense than the mercury. If this control liquid is constituted by oil, the protective liquid may be water or an aqueous solution which can be poured through the channels 13D, but taking care to dose the quantity of mercury initially introduced to avoid any excess which would drive out the protective liquid with it.

On the other hand, it is understood that the casing 1 of the centrifuge may be formed so as to collect the products or sludge ejected from the bowl when said bowl is opened and the control liquid coming from the nozzles, separately.

In the preceding description, the case has been envisaged of a piston-like member which allows the opening of a bowl which is constituted by a bottom whose central hub slides on the hub of the pan of this bowl. However, other arrangements are known in which this wall constitutes only the peripheral part of a bottom otherwise fixed axially, this requiring two sliding seals as part of the mobile wall in question and sealing on the one hand the inner peripheral wall of the bowl to the wall, on the other hand, the central part of the bottom to the wall. In such a case, the outermost seal may be established in hydraulic form in the manner set forth hereinabove, and the inner seal, less exposed to stress, being made conventionally with the aid of a plastic ring, or, as a variant, this inner seal may also be hydraulic.

Furthermore, it has been implicitly assumed hereinabove that the product to be treated constituted a suspension of solid particles in a liquid, but, more generally speaking, the invention is applicable in all cases comprising solid or liquid particles in suspension in a liquid or gaseous phase.

What is claimed is:

1. A centrifugal separator for the treatment of a liquid product containing sludge in suspension, comprising:

a bowl rotatably mounted about an axis, said bowl including a bottom, a cover, and a cylindrical intermediate flange portion disposed between said bottom and said cover, said flange portion having sludge discharge openings;

a movable piston-like member coaxially located in the bowl and forming a secondary bottom, the member being movable along said axis between a first position in which it uncovers said discharge openings and a second position in which it closes said discharge openings;

means to inject a control liquid between said bottom and said piston-like member to cause said piston-like member to move from said first position to said second position against the pressure exerted by the treated product retained between said cover and said piston-like member; and slidable sealing means disposed between said movable piston-like member and said intermediate cylindrical flange portion, the sealing means comprising an hydraulic seal using a sealing liquid having a higher density than said control liquid, said hydraulic seal comprising annular nose means extending radially outwardly from said piston-like member and an annular gutter-shaped member extending radially inwardly from said cylindrical intermediate flange portion, the gutter-shaped member having radially inwardly extending annular means on opposite sides of said annular nose means and confining said higher density sealing liquid to form a first peripheral column of said higher density sealing liquid which is exposed to the pressure created by said control liquid between said bottom and said piston-like member, and further to form a second peripheral column of said higher density sealing liquid which is vented toward said cover and exposed to atmospheric ambient pressure; and further to define a third peripheral column of said higher density liquid which connects said first and second columns at a location which is radially further from the axis of said bowl.

2. In a centrifugal separator as claimed in claim 1, said higher density sealing liquid being mercury.

3. In a centrifugal separator as claimed in claim 1:

-said inwardly extending annular gutter-shaped means on said cylindrical intermediate portion further including a trough having a bottom and first and second axially extending lateral walls;

-said annular nose means on said piston-like member projecting into said inwardly extending gutter-shaped member;

-and said nose member being spaced upwardly above the bottom of said gutter-shaped member and above the first and second lateral walls thereof in both said first and said second positions of said piston-like member and in any position intermediate said first and second positions.

4. In a centrifugal separator as claimed in claim 3, the axis of said bowl being vertical with said piston-like member being above said bottom of said bowl, said first lateral wall of said inwardly extending gutter-shaped annular member extending vertically above said second lateral wall thereof, and said second lateral wall of said gutter-shaped annular member having an upwardly directed cylindrical portion extending above the bottom of said trough to provide therewith an upwardly opening annular trough to receive and retain said sealing liquid when said bowl is not rotating at a high speed.

5. In a centrifugal separator as claimed in claim 4, said annular nose means having a downwardly directed annular extension which descends into said upwardly opening trough while remaining spaced from said upwardly directed cylindrical portion of said second lateral wall.

6. In a centrifugal separator as claimed in claim 4, damping means to damp the flow of control liquid toward and away from the peripheral columns of said hydraulic seal to prevent oscillatory phenomena.

7. In a centrifugal separator as claimed in claim 6, said piston-like member having a cylindrical peripheral portion extending vertically and closely spaced with respect to said first lateral wall of said annular trough-shaped member, and said damping means being formed by the narrow passage provided between said cylindrical peripheral portion of said piston-like member and said first lateral wall of said trough-shaped member.

8. In a centrifugal separator as claimed in claim 1, overflow means to evacuate from the bowl any excess of high density sealing liquid when said bowl begins rotating if the hydraulic seal has been previously overfilled.

9. In a centrifugal separator as claimed in claim 1, deflector means disposed to downwardly redirect any higher density sealing liquid projected from said second peripheral column of said hydraulic seal.

10. In a centrifugal separator as claimed in claim 1, a layer in said gutter-shaped member of protective liquid of a density intermediate between that of said higher density sealing liquid and that of said control liquid, and non-miscible with either one of said sealing and control liquids, to protect said higher density sealing liquid from contact with said control liquid.

* * * * *